US007422072B2

(12) United States Patent
Dade

(10) Patent No.: US 7,422,072 B2
(45) Date of Patent: Sep. 9, 2008

(54) SPRINKLER WEDGE

(76) Inventor: Kent Demond Dade, 617 Elm, Quincy, IL (US) 62301

( * ) Notice: Subject to any disclaimer, the term of this patent is extended or adjusted under 35 U.S.C. 154(b) by 0 days.

(21) Appl. No.: 11/539,527

(22) Filed: Oct. 6, 2006

(65) Prior Publication Data

US 2008/0083544 A1 Apr. 10, 2008

(51) Int. Cl.
*A62C 39/00* (2006.01)
*A62C 2/00* (2006.01)

(52) U.S. Cl. ..... 169/90; 169/43

(58) Field of Classification Search ..... 169/90, 169/37, 43; 251/90; 254/104; 292/342
See application file for complete search history.

(56) References Cited

U.S. PATENT DOCUMENTS 1,167,860 A * 1/1916 Van Dillon et al. ..... 169/90
1,189,820 A * 7/1916 Holmes et al. ..... 169/90
1,325,507 A * 12/1919 Casey ..... 169/90
1,547,116 A * 7/1925 Green ..... 169/90
2,234,290 A * 3/1941 Tessier ..... 169/90
2,466,126 A * 4/1949 Siegel ..... 169/90
2,491,835 A * 12/1949 Seifried ..... 169/90
2,700,423 A * 1/1955 Burkert ..... 169/90
2,743,782 A * 5/1956 Occhipinti ..... 169/39
3,191,685 A * 6/1965 Warne ..... 169/90
3,587,979 A * 6/1971 Butts ..... 239/569
6,575,252 B2 * 6/2003 Reed ..... 169/90
2006/0042803 A1 * 3/2006 Gallaher ..... 169/37

OTHER PUBLICATIONS

Firehouse, Jan. 2005, advertisement No. 166.
Wikipedia, "Fire Sprinkler," printed Aug. 24, 2006.
Huggins, R., "Home Safe," NFPA Journal, May/Jun. 2004.
Mitchell, J. , "We've Come a Long Way, But the Journey Isn't Over," The American Fire Sprinkler Association, (www.firesprinkler.org/technical/articles/obstructions.html), printed Jul. 21, 2006.
Huggins, R., "Evaluating the Impact of Ceiling Pockets on Sprinkler Activation," The American Fire Sprinkler Association, (www.firesprinkler.org/techincal/articles/nfpaceiling.html), printed Jul. 21, 2006.
The Fire Sprinkler Contractor, NFPA Design Standards, and the Consulting Engineer, American Fire Sprinkler Association, Apr. 24, 1999.
National Fire Protection Association, Automatic Sprinkler Systems, (www.nfpa.org/itemDetail.asp?categoryID=276@itemID=182...), printed Aug. 24, 2006.
American Fire Sprinkler Association, Product Index, May 1, 2006.

* cited by examiner

*Primary Examiner*—Darren W Gorman
(74) *Attorney, Agent, or Firm*—Lewis, Rice & Fingersh, L.C.

(57) ABSTRACT

A sprinkler wedge designed for inhibiting water discharge from an open or activated sprinkler head. The sprinkler wedge generally comprises a main body having proximal and distal ends. A handle assembly connected toward the proximal end for easy grasping by a human hand, and a forked tip toward the distal end. The sprinkler wedge is designed for improved single-handed insertion into the water stream of an activated sprinkler head.

11 Claims, 4 Drawing Sheets

SPRINKLER WEDGE

BACKGROUND

1. Field of the Invention

This disclosure relates to the field of sprinkler stops for use with automatic fire sprinkler systems, more particularly to a sprinkler wedge having an integral grasping handle and forked tip.

2. Background of the Invention

Fire protection sprinkler systems are found in a great majority of commercial buildings and factories and are becoming more popular in residential structures as well. Typically, these fire protection systems consist of overhead sprinkler's attached to pipes that run throughout the desired coverage area.

Fire protection systems are designed to automatically distribute water for fire suppression and/or extinguishment purposes through sprinklers or sprinkler heads that are attached to a system of piping at set intervals. Sprinklers may extend from closed piping or protrude through ceilings or wall from hidden piping. A typical activated or open sprinkler head can discharge as much as fourteen (14) gallons of water per minute.

Each sprinkler head is independently held closed by heat sensitive seals which are generally of the form of a breakable cylinder plugging a discharge port. These seals prevent water flow from the pipe to the sprinkler head until a predetermined temperature is exceeded at the individual sprinkler head. When the temperature is reached, the cylinder breaks and water (which is generally under pressure in the attached pipe) can escape in a powerful stream. This stream then impacts a deflector to convert the stream to a shower or "sprinkle." Each sprinkler activates independently when the predetermined heat level is reached. This design limits the total number of sprinkler heads that operate, thereby providing the maximum water supply available from the water source to the point of fire origin and allows the system to react to a spreading or moving fire.

There are several types of fire sprinkler systems, but the two most common types are "wet pipe" and "dry pipe" systems. In wet pipe systems the sprinkler heads are attached to pipes that are under constant water pressure. This system allows the quickest response time when the sprinkler head is opened due to the fact that water is directly behind each sprinkler head in the entire system.

Dry pipe systems are similar in design to wet pipe systems. The main difference is that in a dry pipe system, air pressure holds the water back from the sprinkler heads, at any point where freezing temperatures are a concern for damaging any part of the system. Once a sprinkler head has been opened, all of the air pressure in the system must be expelled through that opening before following water will flow to extinguish the fire.

In each type of system there are different types of sprinkler heads that may be attached to the system piping having different sizes and specific structure. There are also three basic positions for sprinklers; pendant, upright, and sidewall. In upright sprinklers water is forced upward onto a deflector plate that then directs the water down towards the floor in a spray type pattern. Pendant sprinkler heads are oriented in a downward position from the piping and when the system is activated water is forced downward from the piping onto the deflector plate of the sprinkler head whereby the water is then directed onto the floor and possibly the ceiling in a spray type pattern. Sidewall sprinkler heads operate in the same way as pendant and upright sprinkler heads, the difference being the sprinkler heads extend from a sidewall instead of the ceiling and may have a restricted sprinkle pattern.

Sprinkler heads, once activated or open, continue to deliver water to the area even after the fire has been extinguished or suppressed until either the discharge port is again blocked, or the water source is turned off. This provides for a system which is responsive to a fire, even during an existing fire. The constant flow of water that was initially necessary for fire extinguishment and suppression, however, can be the source of numerous problems once the fire is out. The flowing water may cause damage to merchandise and personal property sometimes to an even greater extent than the fire itself. The weight of the water may also create structural integrity issues for the building. The constant deluge of water also creates visibility issues and makes traveling through the area more difficult for fire response personnel or other individuals responding to the sprinkler head activation or opening.

Shut off valves are built into the fire sprinkler systems, however, these shut off valves generally can not be used until it is confirmed by the fire response personnel that all fire has been completely extinguished and that the fire has not spread to other parts of the structure. Otherwise, fire could tunnel through walls and begin to burn in a new location with the sprinkler being unable to respond. This creates a problem both in extinguishing the fire, and also in recognizing it is even burning in the new location. As a result, devices are used by firefighters to halt the water flow individually from each activated or open sprinkler head by plugging the individual discharge ports.

Devices currently used to stop water flow from an activated sprinkler are typically wooden wedges or complex mechanical devices. These sprinkler stop devices are designed to be inserted inside of the frame arms of the sprinkler head between the discharge port and the deflector. These devices, however, generally have two major deficiencies. First, wedges generally require the use of a tool, such as a mallet to force the device into place in between the frame arms of the sprinkler device. Not only does this necessitate individuals to carry extra equipment, but it also requires more time to hinder the flow of water than would a device which does not require any additional equipment. Further, the devices require two hands to use. This can be problematic as one hand is often needed to shield the firefighters eyes from the spray so they can see where to insert the wedge in the first place. Many of these devices are also difficult and time consuming to operate and may take longer than desired to insert in to an activated or open sprinkler head and extend or modify to block the discharge port. Still further, many devices are difficult to insert in the powerful stream of water coming from the discharge port, the force of the water knocking the device away as firefighters attempt to thread it into the sprinkler head to block the water stream.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems known to those of skill in the art, described herein, among other things, is a sprinkler wedge designed to be inserted into the frame of a sprinkler head to block the water discharge port of the sprinkler head and reduce or eliminate the water expulsion from the sprinkler head. Further, the sprinkler wedge is designed to be able to be inserted into the frame of the activated or open sprinkler head quickly with one hand and without the need for any additional devices or tools.

In an embodiment, a sprinkler wedge comprises: a main body having a distal and proximal end and a length therebetween, the main body having a generally wedge shape with the larger portion of the wedge toward the proximal end; a handle assembly attached at the proximal end of the main body; a forked tip arranged toward the distal end of the main body, the forked tip including at least two tines and a space therebetween; and a groove arranged on a top surface of the main body; wherein the main body is sized and shaped to pass through a central opening of a fire sprinkler head between two frame arms.

In an embodiment of the sprinkler wedge the top surface has a convex shape and the base of the wedge is flat In another embodiment, the handle assembly comprises a handle, which may be cylindrical in shape, arranged perpendicular to the length of the main body and there is a neck connecting the handle to the main body.

In another embodiment of the wedge, a reinforcing bar is placed interior to the handle, the neck and the main body or the groove may be sized and shaped to slide over a screw head of a screw connecting a deflector plate to the two frame arms.

There is also described herein, a method of inhibiting water flow from an open sprinkler head, the method comprising: providing a sprinkler head having a water stream exiting a discharge part and impacting a deflector plate; providing a sprinkler wedge, the wedge including: a wedge shaped main body; a handle assembly at a proximal end of the main body; and a forked tip at a distal end of the main body, the forked tip including at least two tines with a space therebetween; grasping the handle; placing the forked tip at the sprinkler head such that the water stream passes between the tines; and pushing the main body into the water stream until the main body is stably in contact with the sprinkler head and the water stream is at least partially blocked by the wedge.

In an embodiment of the method the groove passes over a screw head in the sprinkler head.

DESCRIPTION OF THE PREFERRED EMBODIMENTS(S)

Figure 1:
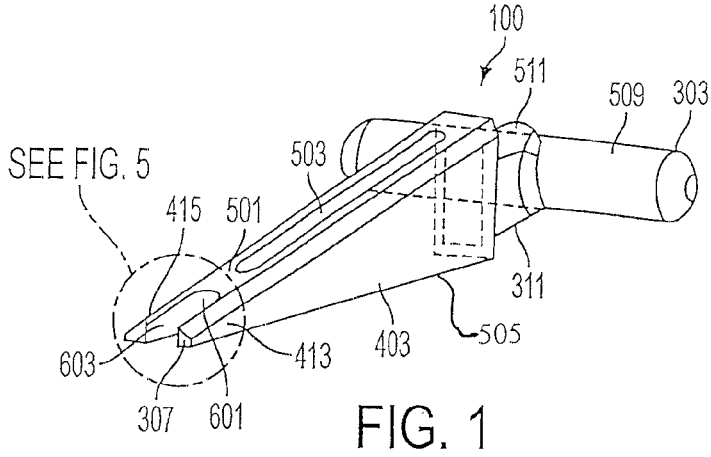
FIG. 1 provides a perspective view of an embodiment of a sprinkler wedge
Figure 2:
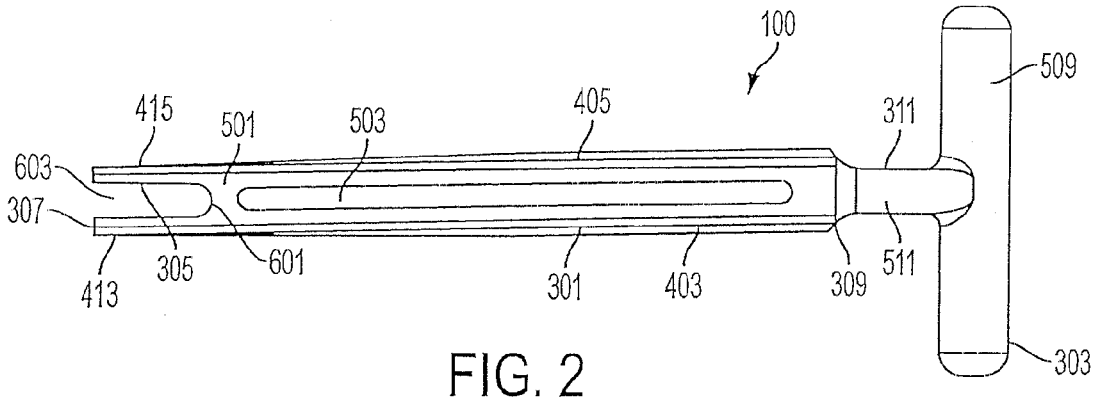
FIG. 2 provides a top view of the embodiment of FIG. 1.
Figure 3:
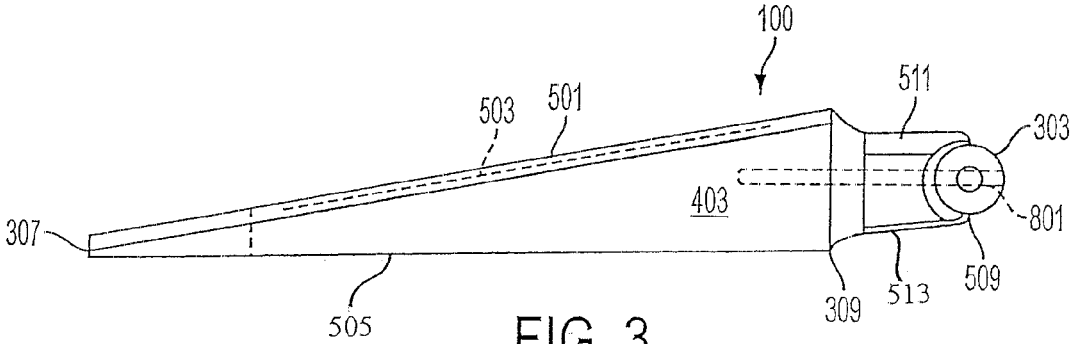
FIG. 3 provides a side view of the embodiment of FIG. 1.
Figure 4:
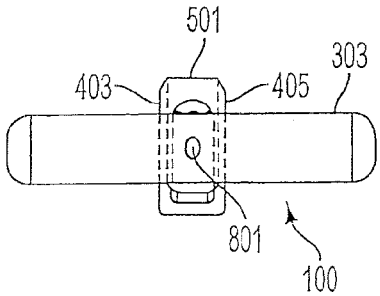
FIG. 4 provides an end view of the embodiment of FIG. 1.
Figure 5:
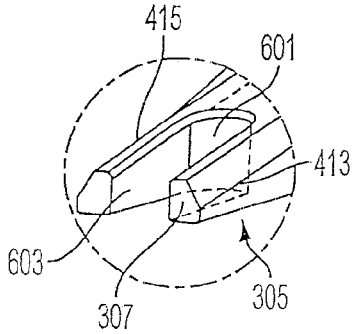
FIG. 5 provides a detail view of the embodiment of FIG. 1 showing the forked tip.
Figure 6:
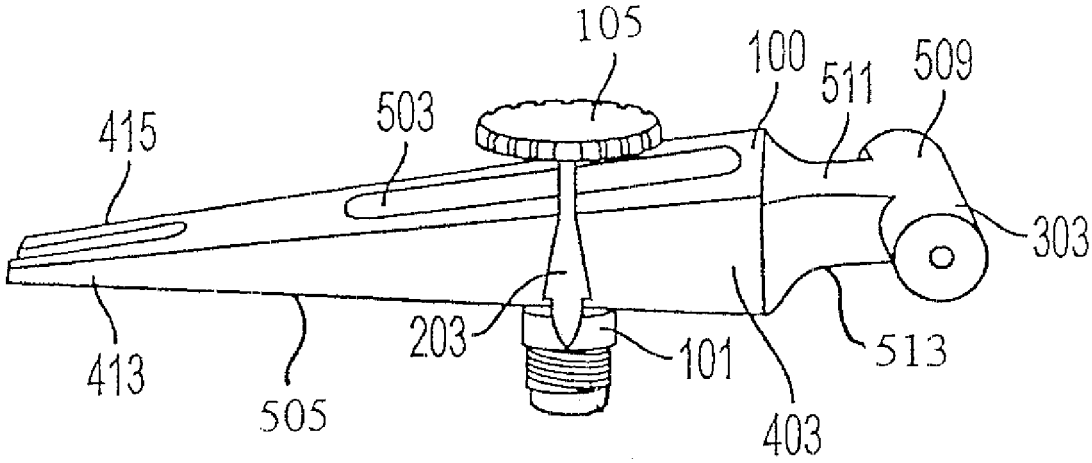
FIG. 6 provides a perspective view of the embodiment of the sprinkler wedge of FIG. 1 inserted into a sprinkler head as it would be when in use.
Figure 7:
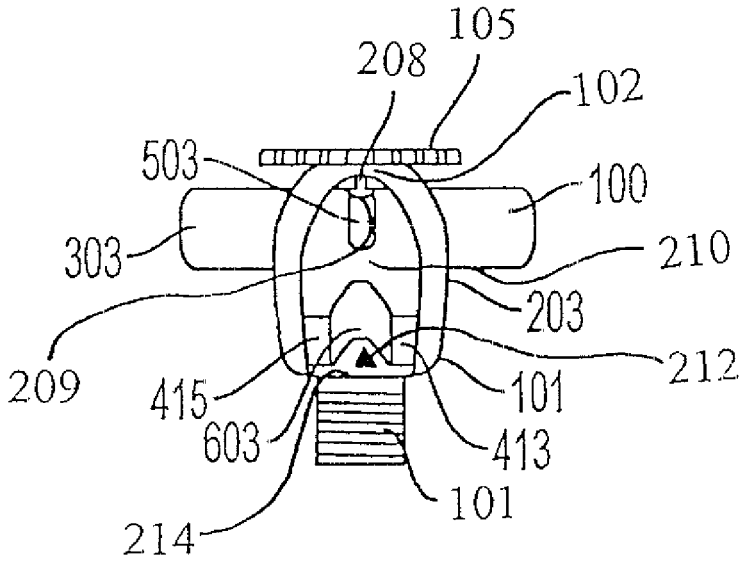
FIG. 7 provides an end view of the situation of FIG. 6.

FIGS. 1 through 5 provide for various different views of a first embodiment of a sprinkler wedge (100) designed to hinder water flow from an open or activated sprinkler head (101) in a fire sprinkler system. In the depicted embodiment, the sprinkler wedge (100) includes a handle (303), a main body (301) and a forked tip (305). In a preferred embodiment, the sprinkler wedge (100) will generally be manufactured of plastic, rubber or some other material that is fairly lightweight and relatively rigid with the material preferably containing some elastic properties to allow the sprinkler wedge (100) to form a tight seal with a sprinkler head discharge port (212) when it is threaded through the sprinkler head (101) frame arms (103) as shown in FIGS. 6 & 7. The sprinkler head shut off (100) generally will be molded as a single monolithic piece or assembled to form a basically unitary piece construction.

The main body (301) of the depicted embodiment has a generally wedge-shaped design. That is, the design has a triangular form which, specifically in the depicted embodiment, is in the shape of a right triangle. The proximal end (309) of the main body (301) is generally greater in height than the distal end (307) of the main body (301) which results in a taper in the top surface (501) along the length of the main body (301) from the proximal end (309) to the distal end (307). The slope of the taper of the main body (301) is generally designed to be relatively linear but that is by no means required.

In the depicted embodiments, the top surface (501) is curved or bent outward from the main body (301) toward the anterior lateral surface (403) and posterior lateral surface (405) in an arcing fashion as is most clearly seen in FIG. 7. This curvature of the top surface (501) allows the sprinkler wedge (100) to generally conform to the shape of the sprinkler head (101) as the interior surfaces of the sprinkler head frame arms (203) may themselves be fashioned with an arc near the sprinkler head deflector plate (105). While the curve outward from the top surface (501) is the generally preferred design as it provides for a tighter fit, the top surface (501) may be of any shape and may, for instance, form right angles with the anterior lateral surface (403) and posterior lateral surface (405) or it may be in any shape or form in alternative embodiments Along the top surface (501) there is included a groove (503) which forms a recess in the top surface (501) of the main body (301). The groove (503) may extend any distance along the top surface (501). The groove (503) will generally be formed in a concave arc with respect to the top surface (501) and will generally extend virtually the entire length of the top surface (501) from the rear wall (601) of the fork (305) to the proximal end (309) of the main body (101).

In a preferred embodiment the groove (503) will generally be placed in the center of the top surface (501), equidistant between the anterior lateral surface (403) and the posterior lateral surface (405).

Figure 9:
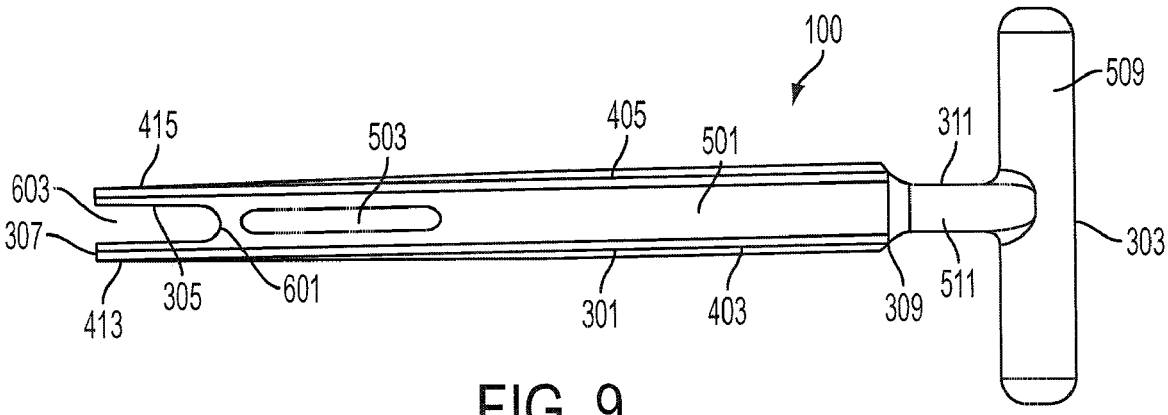
FIG. 9 provides a top view of an alternative embodiment of a sprinkler wedge.

In the alternative embodiment of FIG. 9, the groove (503) in the top surface (501) is shown shorter and terminates at a position significantly prior to the proximal end (309) of the main body (301). This embodiment may be useful when smaller sprinkler heads (101) are the only type of heads expected to be encountered. Further, one of ordinary skill would recognize that the exact length of the groove (503) is variable and is generally selected so that the groove (503) has sufficient width to interact with the screw head (209).

Toward the proximal end (309) of the sprinkler head shut off (100) there is attached a handle assembly (509). The handle assembly (509) generally comprises a handle (303) and a neck (311). Depending on the embodiment, the attachment of the handle assembly (509) may occur in any manner including co-forming which serves to attach the handle (303) to the main body (301). The neck (311) may be of a smaller effective diameter or height than the main body (301). In the depicted embodiment, the neck (311) is formed by a curve reducing the main body (301) height to a dimension nearer to that of the handle (303). This reduction of height is a result of a curved section of the neck (311) at the top of the neck (511) and bottom of the neck (513). There need not be any reduction of width as perceived from the anterior lateral surface (403) and posterior lateral surface (405). The height of the neck (311) at its attachment to the handle (303) may be equal to the diameter of the handle (303). The handle (303) is preferably of a generally cylindrical shape arranged perpendicular to the main axis of the main body (301) and extending a length beyond the anterior lateral surface (403) and the posterior lateral surface (405) of the main body (301). This design allows for ease of molding or manufacturing and provides for a relatively T-shaped handle assembly (509) when viewed from above which is easily grasped and manipulated.

Toward the distal end (307) of the sprinkler wedge (100) the structure is arranged to form a generally forked tip (305). The forked tip (305) generally comprises two tines (413) and (415) extending from the anterior lateral surface (403) and the posterior lateral surface (405) respectively. The tines (413) and (415) are generally arranged the same distance apart as anterior lateral surface (403) and posterior lateral surface (405) and have an opening (603) between them. Where the tines (413) and (415) meet the main body (403) there is generally a smooth rear wall (601) which may have a curved shape. The detail view of FIG. 5 provides for further detail of the pictured embodiment of the forked tip (305).

In an embodiment, there may be a reinforcing bar (801) that runs through the handle (303), and the neck (311) to a point in the main body (301). The reinforcing bar (801) is generally made of a firm, stiff material such as steel, and can provide the sprinkler wedge (100) with additional strength and rigidity. The reinforcing bar (801) may be desirable depending on the material of which the sprinkler wedge (100) is constructed but is by no means required.

Figure 8:
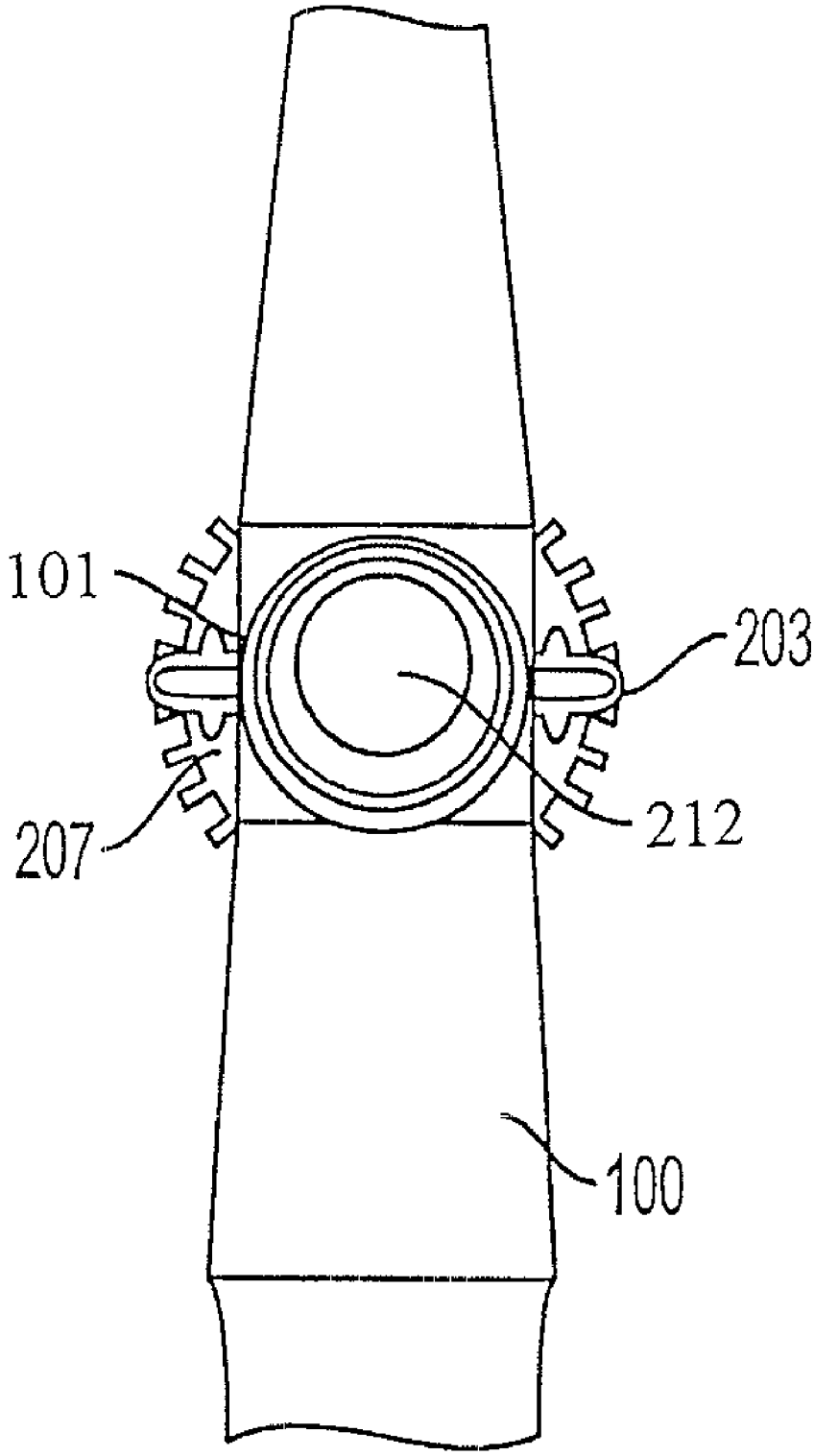
FIG. 8 provides a bottom view of the situation of FIG. 6.

FIGS. 6 through 8 show an example of how the sprinkler wedge (100) interacts with a sprinkler head (101). The base (505) of the sprinkler wedge (100) is a generally flat or otherwise contoured surface designed to interact with the surface (214) of the sprinkler head (101) including the discharge port (212). The two sprinkler frame arms (203) also extend from surface (214). The two frame arms (203) converge to a point (102) where the deflector plate (105) is attached. The plate (105) may be welded to the arms (203), but is generally instead connected by a screw (211) whose screw head (209) is within the central opening (210) defined by the frame arms (203) and the surface (214) including the discharge port (212). Prior to activation, the opening (210) will generally have a breakable cylinder (not shown) located therein to plug the discharge port (212).

The sprinkler wedge (100) provides a number of features for improving the ease of insertion into an active or open sprinkler head (101). In particular, the forked end permits the water discharge from the sprinkler head discharge port (212) to pass through the opening between the tines (413) and (415) as the wedge is positioned. Therefore, the sprinkler head shut off (100) will not be deflected out of the sprinkler head shut off (100) by the force of the water as the user is attempting to position it. As should be apparent, the placement of the wedge inside the sprinkler frame arms (203) requires fairly careful positioning. When the head (101) is discharging water, the force of the spray (which is between the frame arms (203) can easily deflect a device during its positioning. The existence of the forked tip allows the sprinkler wedge (100) to be positioned in the central space prior to the water stream contacting the device (as the stream passes between the tines). Once the stream contacts the main body (301) the tines (413) and (415) are already through the opening, so the water stream does not force the wedge (100) out of the opening, simply toward the deflector plate (105). The handle provides for a firm grip and leverage to allow the user to push the device further into the stream and the wedge shape provides additional leverage moving the base (505) closer to the discharge port (212).

In particular, the water pushes the tapered top surface (501) into the connection point of the two frame arms (203), therefore motion along the length of the sprinkler wedge (100) from the handle serves to both move the wedge (100) further into the central space (210) in the sprinkler (101) and move the base (505) toward the discharge port. The groove (503) can provide for a space for the screw head (209) to pass through as the wedge (100) is positioned. This decreases side to side wobble of the wedge (100) as it is being forced in between the frame arms (203). Eventually, the wedge (100) has reached a point in its length where the height is fairly close to the height of the central opening (210) of the sprinkler head (101). At this time the wedge effectively plugs the central opening significantly decreasing, if not totally stopping, water flow from the discharge port (212).

Further, the wedge is generally fitted quite tightly in the central opening at this position having contact with most of the frame arms (203), which serves to hold the wedge (100) in place when the handle (303) is released. In an alternative embodiment, the structure could be such that the handle (303) could be turned once the wedge (100) is positioned in the central opening. This could allow for the base (505) to be brought into a closer proximity with the discharge port (212) if the sprinkler (101) was of a slightly different size or shape. In a still further embodiment, the turning handle (303) could result in extension or expansion of a portion of the wedge (100) to also provide for improved blocking characteristics.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosures as would be understood by those of ordinary skill in the art.

The invention claimed is:

1. A sprinkler wedge comprising:

a basically unitary main body having a distal and proximal end and a length therebetween, the main body having a generally wedge shape with the larger portion of the wedge toward said proximal end;

a handle assembly attached at said proximal end of said main body;

a forked tip arranged toward said distal end of said main body, said forked tip including at least two tines and a space therebetween; and a groove arranged on a top surface of said main body;

wherein said main body is sized and shaped to pass through a central opening of a fire sprinkler head between two frame arms;

and wherein said forked tip and said groove are immobile relative to each other.

2. The sprinkler wedge of claim 1 wherein said top surface has a convex shape.

3. The sprinkler wedge of claim 2 wherein a base of said wedge is flat.

4. The sprinkler wedge of claim 1 wherein said handle assembly comprises a handle arranged perpendicular to said length of said main body and a neck connecting said handle to said main body.

5. The sprinkler wedge of claim 4 wherein said handle is cylindrical in shape.

6. The sprinkler wedge of claim 4 wherein a reinforcing bar is placed interior to said handle, said neck and said main body.

7. The sprinkler wedge of claim 1 wherein said groove is sized and shaped to slide over a screw head of a screw connecting a deflector plate to said two frame arms.

8. A method of inhibiting water flow from an open sprinkler head, the method comprising:

providing a sprinkler head having a water stream exiting a discharge port and impacting a deflector plate;

providing a sprinkler wedge, said wedge including;

a basically unitary wedge shaped main body;

a handle assembly at a proximal end of said main body;

a forked tip at a distal end of said main body, said forked tip including at least two tines with a space therebetween; and a groove arranged on a top surface of said main body;

wherein said forked tip and said groove are immobile relative to each other;

grasping said handle;

placing said forked tip at said sprinkler head such that said water stream passes between said tines;

pushing said main body into said water stream until said main body is stably in contact with said sprinkler head and said water stream is at least partially blocked by said wedge.

9. The method of claim 8 wherein in said step of pushing, said groove passes over a screw head in said sprinkler head.

10. The sprinkler wedge of claim 1 wherein the sprinkler wedge is comprised of rubber.

11. The sprinkler wedge of claim 10 wherein the elastic properties of said rubber allow the wedge to form a tight seal with the sprinkler head discharge port.

* * * * *